US006152558A

United States Patent [19]

Togashi et al.

[11] Patent Number: 6,152,558

[45] Date of Patent: Nov. 28, 2000

[54] INK JET PRINTER

[75] Inventors: Shigemi Togashi; Toshimasa Shiobara, both of Tokyo, Japan

[73] Assignee: Oki Data Corporation, Tokyo, Japan

[21] Appl. No.: 09/020,419

[22] Filed: Feb. 9, 1998

[30] Foreign Application Priority Data

Feb. 12, 1997 [JP] Japan ..... 9-028107

[51] Int. Cl.[7] ..... B41J 2/175; B41J 2/14

[52] U.S. Cl. ..... 347/86; 347/49

[58] Field of Search ..... 347/85, 86, 87, 347/49; 399/119, 120, 223, 224

[56] References Cited

U.S. PATENT DOCUMENTS

| | | | |
|---|---|---|---|
| 5,148,194 | 9/1992 | Asai et al. | 347/49 |
| 5,408,746 | 4/1995 | Thoman et al. | 347/49 |
| 5,912,689 | 6/1999 | Otsuka et al. | 347/86 |
| 6,007,191 | 12/1999 | Fujii et al. | 347/87 |
| 6,012,808 | 1/2000 | Koitabashi | 347/86 |

FOREIGN PATENT DOCUMENTS 0 639 462 A2 2/1995 European Pat. Off. .

0 674 997 A2 10/1995 European Pat. Off. .

*Primary Examiner*—N. Le
*Assistant Examiner*—Judy Nguyen
*Attorney, Agent, or Firm*—Rabin & Champagne, PC

[57] ABSTRACT

A carriage accommodates a plurality of ink tanks including a first ink tank and second ink tanks, all being detachably attached in the carriage. Each ink tank holds ink of a color different from others. The carriage further includes a plurality of ink entrances provided therein, each ink entrance receiving ink from a corresponding ink tank. The first ink tank is generally L-shaped and has an ink capacity larger than any of the second ink tanks. The first ink tank holds, for example, black ink therein. The first ink tank and the second ink tanks are attached in the carriage in such a fashion that the first ink tank holds the second tanks in a space defined by the L-shape. The first and second ink tanks are formed with engagement portions which engage each other in a complementary relation when the ink tanks have been assembled in the carriage. The first ink tank has at least one ink exit and may further include caps. The ink exit and the caps are formed in alignment with the ink entrances in the carriage.

10 Claims, 10 Drawing Sheets

INK JET PRINTER

BACKGROUND OF THE INVENTION

1. Field of the Invention

The present invention relates to an ink jet printer.

2. Description of Related Art

With a conventional color printer, colored ink is supplied from a corresponding ink tank to a corresponding printhead. Then, the colored ink is ejected through the orifices of the printhead in accordance with print data.

FIG. 10 is a perspective view of a relevant portion of a conventional ink jet printer. Referring to FIG. 10, a carriage 12 is slidably supported on a carriage shaft 11 and reciprocated along the carriage shaft 11. The carriage 12 carries four printheads 14 and an ink tank unit 15 thereon. The ink tank unit 15 includes four ink tanks 15Y, 15M, 15C, and 15B aligned in line from left to right in FIG. 10. The ink tanks 15Y, 15M, 15C, and 15B hold yellow ink, magenta ink, cyan ink, and black ink, respectively.

The ink tanks 15Y, 15M, 15C and 15B have ink exits 17Y, 17M, 17C, and 17B projecting downwardly from the bottom of the tanks. The carriage 12 has ink entrances 16Y, 16M, 16C, and 16B into which the ink exits 17Y, 17M, 17C, and 17B are fitted when the ink tanks are attached to the carriage 12.

The respective colored inks are directed via the ink entrances 16Y, 16M, 16C, 16B to the corresponding printheads 14 and are ejected through orifices, not shown. The ink tanks 15Y, 15M, 15C, and 15B are formed with recesses 15*a* in their side surfaces and the carriage 12 has upward projections 12*m* with latches 12*h* formed correspondingly to the recesses 15*a*. When the ink tank 15Y, 15M, 15C, and 15B are inserted into the carriage 12, the latches 12*h* will snap into the recesses 15*a,* holding the ink tank unit 15 in place.

In color printers, black ink is consumed more than inks of primary colors. Thus, the ink tanks 15Y, 15M, 15C and 15B are, for example, of the same height and depth but the ink tanks 15Y, 15M, and 15C are narrower in width than the ink tank 15B. Thus, the ink tank 15B has a larger volume than the other ink tanks, establishing a large volume ratio of the black ink to the ink tanks of primary color.

However, the ink tanks have ink exits formed at their bottom surfaces and therefore the width of the ink tanks cannot be smaller than the size of the ink exists. This indicates that the volume ratio of the ink tank of black to each of the ink tanks of primary colors cannot be increased any further for the same size of the carriage. This is a barrier to further miniaturization of the ink tanks.

One way of increasing the volume ratio is to make the ink tank 15B larger in the direction of the carriage shaft and to make the carriage larger in the direction of the carriage shaft accordingly. However, making the carriage larger in the direction of the carriage shaft is detrimental since such an increase in dimension increases the lateral dimension of the printer. The maximum width of a print medium that a printer can print is one of the major performances of the printer and it is desirable that a small-size printer can print on a print medium having a large width. Thus, increasing the lateral dimension of the printer is an obstacle to miniaturizing the printer.

SUMMARY OF THE INVENTION

An object of the invention is to provide an ink jet printer which is capable of storing as large a volume of black ink as possible, the black ink being consumed more than other colored inks.

A carriage is mounted on a carriage shaft and reciprocated along the carriage shaft. The carriage accommodates a plurality of ink tanks including a first ink tank and second ink tanks, all being detachably attached in the carriage and each holding ink of different color from the others. The carriage further includes a plurality of ink entrances provided therein, each ink entrance receiving ink from a corresponding ink tank. The first ink tank has an ink capacity larger than any of the second ink tanks and may hold, for example, black ink therein which is most frequently used in a color ink jet printer. The first ink tank is generally L-shaped and includes a vertical portion and a horizontal portion communicating with the vertical portion. The first ink tank is formed with first engagement portions and the second ink tanks are formed with second engagement portions. When the all of the plurality of ink tanks have been attached in the carriage, the first ink tank engages the second ink tanks such that the first ink tank holds the second tanks in a space defined by the L-shape with the first and second engagement portions engaging each other in a complementary relation. The first ink tank may have at least one ink exit and caps, and the ink exit and the caps are formed in alignment with the ink entrances formed in the carriage.

Further scope of applicability of the present invention will become apparent from the detailed description given hereinafter. However, it should be understood that the detailed description and specific example, while indicating prepared embodiments of the invention, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The invention will be described in detail with reference to the drawings.

First Embodiment

Figure 1:
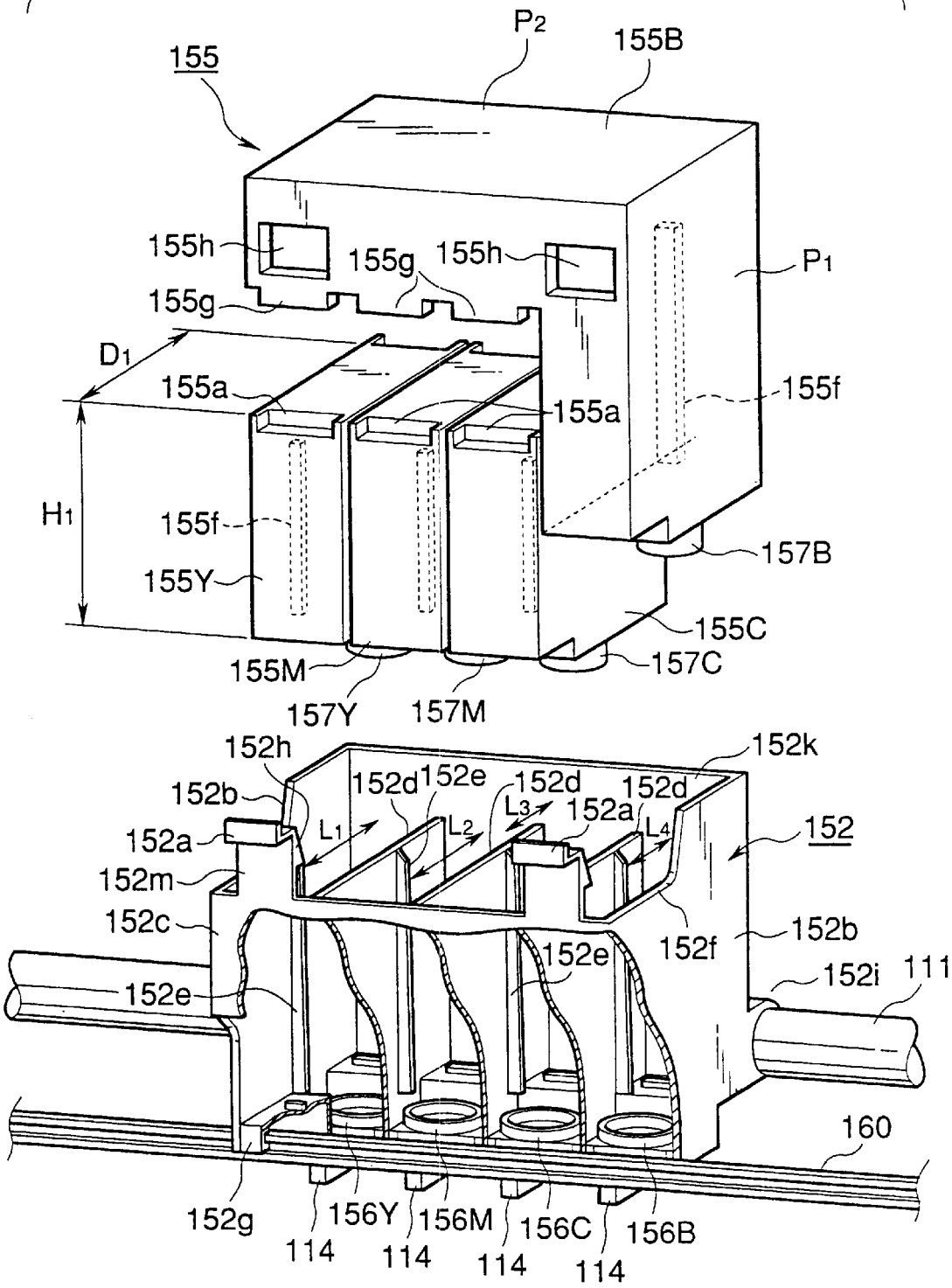
FIG 1 is an exploded perspective view of a carriage and an ink tank unit for an ink jet printer according to a first embodiment of the invention.
Figure 2:
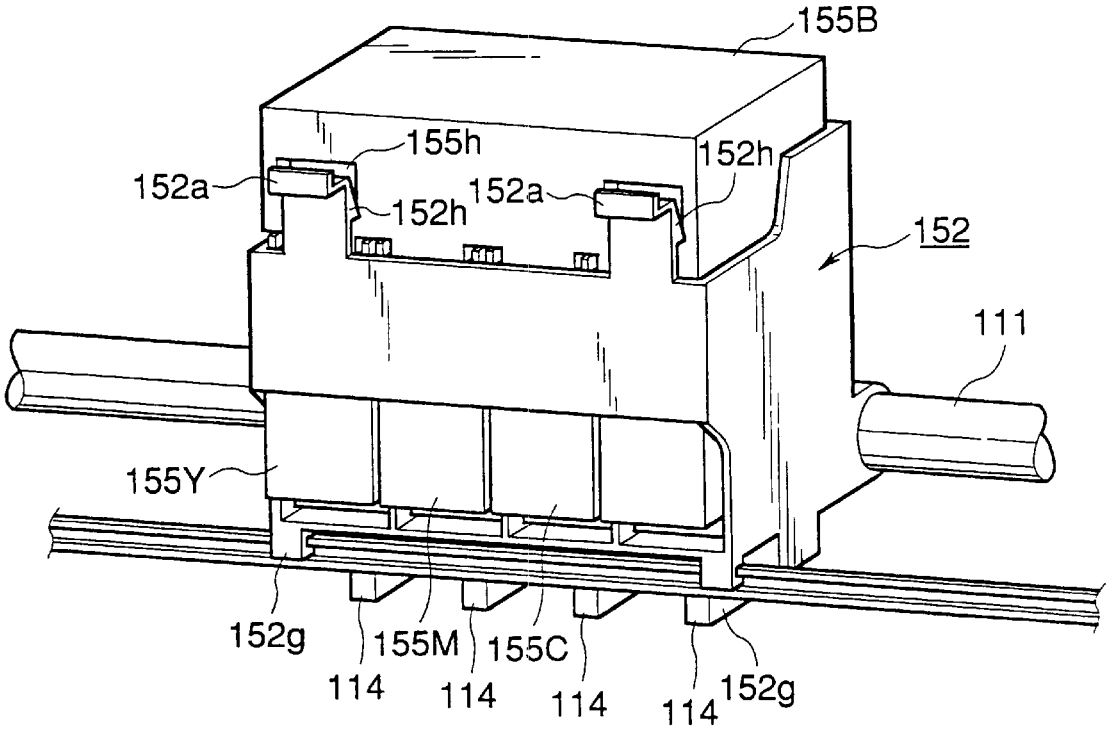
FIG. 2 is a perspective view of the ink tank unit attached in the carriage according to the first embodiment.

FIG. 1 is an exploded perspective view of a carriage and ink tank unit for an ink jet printer according to a first embodiment of the invention. FIG. 2 is a perspective view of the ink tank unit attached in the carriage.

Referring to FIG. 1, a carriage 152 is slidably supported on a carriage shaft 111 which extends through a support 152*i* of the carriage 152. The carriage 152 carries printheads 114 and ink tank unit 155 thereon and reciprocates along the guide rail 160 and carriage shaft 111. The carriage 152 includes a front wall 152*c*, a rear wall 152*k*, two opposite side walls 152*b*, and guide hooks 152*g* which slidably engage the guide rail 160. The front wall 152*c* is lower than the rear wall 152*k*. The carriage 152 further includes walls 152*d* by which the carriage 152 is partitioned into individual ink tank rooms. The ink tank rooms have ink entrances 156Y, 156M, 156C, and 156B formed in the bottoms thereof. Each wall 152*d* has a guide rib 152*e* which extends vertically along the wall 152 to facilitate insertion of an ink tank into a corresponding ink tank room. The guide ribs 152*e* are formed on the walls 152*d* such that they are at mutually different distances L1, L2, L3, and L4 from corresponding ends of the walls 152. The distances L1, L2, L3, and L4 are related by L1>L2>L3>L4. Each of the opposing side walls 152*b* is formed with a cutout 152*f* lower than the ink tanks so that the ink tanks can be easily taken out from the carriage 152. The front wall 152*c* has two projections 152*m* formed with latches 152*h* which engage the ink tank 155B to hold the ink tank 155B in place when the ink tank 155B is inserted into the carriage 152.

The ink tank unit 155 includes four ink tanks 155Y, 155M, 155C, and 155B, which are aligned side by side from left to right in FIG. 1 and hold yellow ink, magenta ink, cyan ink, and black ink, respectively. The ink tanks 155Y, 155M, and 155C are of the same volume or capacity. The ink tank 155B is generally L-shaped, including a vertical portion P1 and a horizontal portion P2 which extends over the ink tanks of primary colors when attached into the carriage 152. Thus, the ink tank 155B has a larger volume than any one of the three other ink tanks, having a predetermined volume ratio to each of the three ink tanks 155Y, 155M, and 155C. The ink tanks are provided with ink exits 157Y, 157M, 157C, and 157B, respectively, which open and project downwardly. The ink exits include valves that are closed to provide a seal against the environment when the ink tanks 155Y, 155M, 155C, and 155B are not attached to the carriage.

The ink tanks are formed with vertically extending grooves 155*f* in correspondence with the ribs 152*e*, the grooves being at mutually different distances L1, L2, L3, and L4 from corresponding ends of the ink tanks. The distances L1, L2, L3, and L4 are related by L1>L2>L3>L4. Each groove 155*f* fittingly engages a corresponding guide rib 156*e* to guide the ink tank into the carriage 152, thereby preventing inadvertent misplacement of the ink tanks in the carriage 152. The ink tanks 155Y, 155M, 155C are formed with stepped portions 155*a* at their top corners and the ink tank 155B is formed with projections 155*g* corresponding to the stepped portions 155*a*. The ink tank 155B also has two recesses 155*h* in its outer wall of the horizontal portion P2. When the ink tank 155B is attached into the carriage 152 after the ink tanks 155Y, 155M, 155C, and 155B have been attached, the three projections 155*g* are received in the stepped portions 155*a* firmly holding the three other ink tanks. At the same time, the latches 152*h* of the carriage 152 snap into the recesses 155*h*, holding the ink tank 155B in position in the carriage 152. When the ink tank 155B has been completely held, all the ink tanks are securely held in place as shown in FIG. 2. When the ink tanks 155Y, 155M, 155C, and 155B have completely attached, the ink exits 157Y, 157M, 157C, and 157B fit into the ink entrances 156Y, 156M, 156C, and 156B, respectively, in a sealing relation, so that ink of each ink tank is supplied to a corresponding printhead, not shown. When the ink tank 155B has been attached in the carriage 152, the projections 155*g* of the ink tank 155B push the three other ink tanks 155Y, 155M, and 155C downward so that the ink tank 155B securely holds the three other ink tanks in the carriage 152.

It is to be noted that no particular fixing member is required to securely attach the ink tanks 155Y, 155M, and 155C since the ink tank 155B holds the three other ink tanks.

When taking out the ink tank 155B from the carriage 152, tabs 152*a* above the latches 152*h* can be pulled toward the user. The projections 152*m* resiliently deform so that the latches 152*h* move out of engagement with the recesses 155*h* and the ink tank may be taken out with the hand. The two side walls 152*b* and the front and rear walls 152*k* and 152*c* may be omitted.

The aforementioned construction makes the volume of the ink tank 155B about two to four times that of the other three ink tanks without the need for making the width of ink tanks 155Y, 155M, and 155C narrower. Further, the construction requires less frequent replacement of the ink tanks.

Second Embodiment

Figure 3:
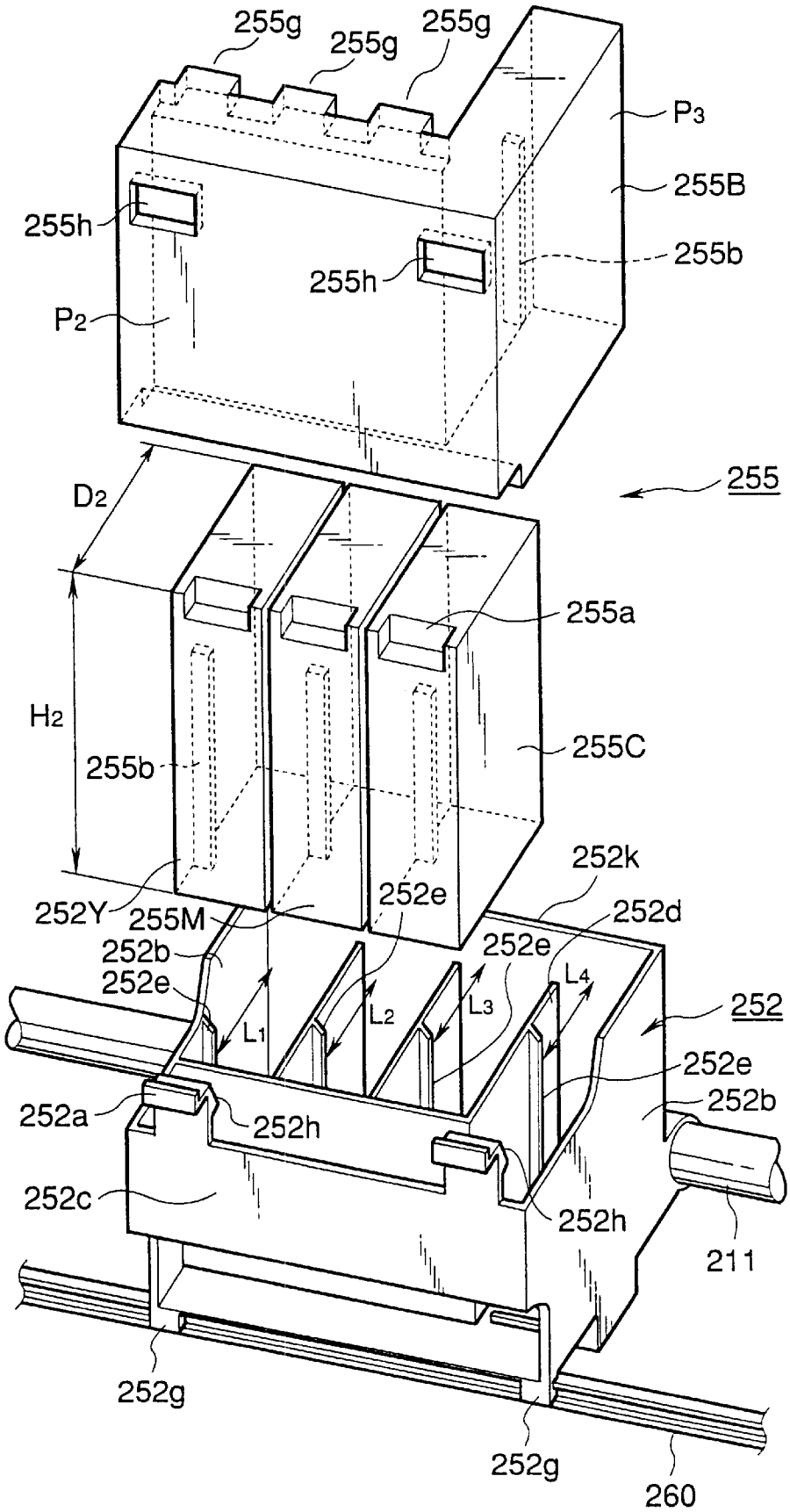
FIG. 3 is an exploded view of a carriage and ink tank unit for an ink jet printer according to a second embodiment.
Figure 4:
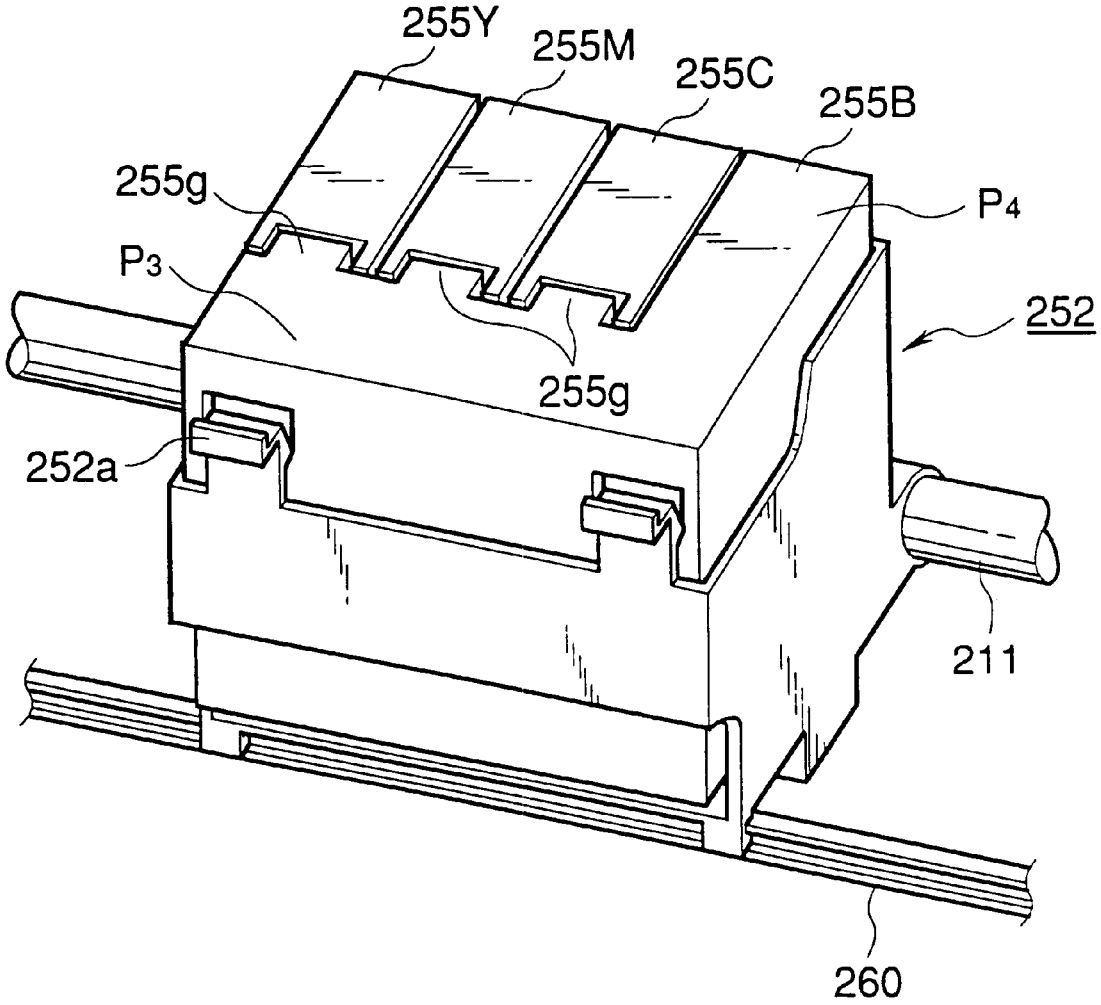
FIG. 4 is a perspective view of the ink tank unit of the second embodiment when it is attached in the carriage.

FIG. 3 is an exploded view of a carriage and ink tank unit for an ink jet printer according to a second embodiment. FIG. 4 is a perspective view of the ink tank unit when it is attached in the carriage.

The second embodiment will be described with respect to a portion that differs from the first embodiment.

The overall size of a carriage 252 is substantially the same as the carriage 152 of the first embodiment. The carriage 252 is partitioned by walls 252*d* into individual rooms. The walls have vertically extending guide ribs 252*e* thereon. The guide ribs 252*e* are formed on the walls 252*d* such that they are at mutually different distances L1, L2, L3, and L4 from corresponding ends of the walls 252*d*. The distances L1, L2, L3, and L4 are related by L1>L2>L3>L4.

Ink tanks 255Y, 255M, 255C, and 255B hold yellow ink, magenta ink, cyan ink, and black ink, respectively. A black ink tank 255B is generally L-shaped including a portion P3 and a portion P4. When attached into the carriage 252, the ink tank 255B extends in a lateral direction to cover the ink tanks of primary colors 255Y, 255M, and 255C. The height H2 and depth D2 of the ink tanks 255Y, 255M, and 255C and the height H1 and depth D1 of the ink tank 255B are related by D2>D1 and H1<H2. The ink tank 255B has three lateral projections 255*g*. The ink tanks 255Y, 255M, and 255C have stepped portions 255*a* at their upper corners. All of the ink tanks 255Y, 255M, 255C, and 255B are formed with vertically extending guide grooves 255*b* in their outer wall surfaces at mutually different distances from corresponding ends of the outer walls, so that the guide ribs 252*e* slidably fit into the guide grooves 255*b* when the ink tanks are attached into the carriage. This construction prevents inadvertent misplacement of the ink tanks in the carriage. The guide grooves 255*b* are at mutually different distances L1, L2, L3, and L4 from corresponding ends of the ink tanks. The distances L1, L2, L3, and L4 are related by L1>L2>L3>L4.

When the ink tank 255B is inserted into the carriage 252 after the ink tanks 255Y, 255M, and 255C have been attached, the projections 255*g* are received into the stepped portions 255*a*, the ink tank 255B firmly laterally holding the three ink tanks in place and the latches 252*h* of the carriage 252 snap into engagement with the recesses 255*h* in the ink tank 255B. Thus, upon attaching the ink tank 255B, the projections 255*g* of the ink tank 255B push the three other ink tanks downward so that the ink tank 255B securely holds the three other ink tanks in the carriage 252 as shown in FIG. 4. When taking out the ink tank 255B from the carriage 252, it is only necessary to pull the tabs 252*a* above the latches 252*h* toward the user so that the latches disengage from the recesses 255*h*. Upon attaching the ink tanks in the carriage 252, the ink exits, not shown, are received into the ink entrances, not shown, in a sealing relation so that each colored ink is supplied to a corresponding printhead.

Third Embodiment

Figure 5:
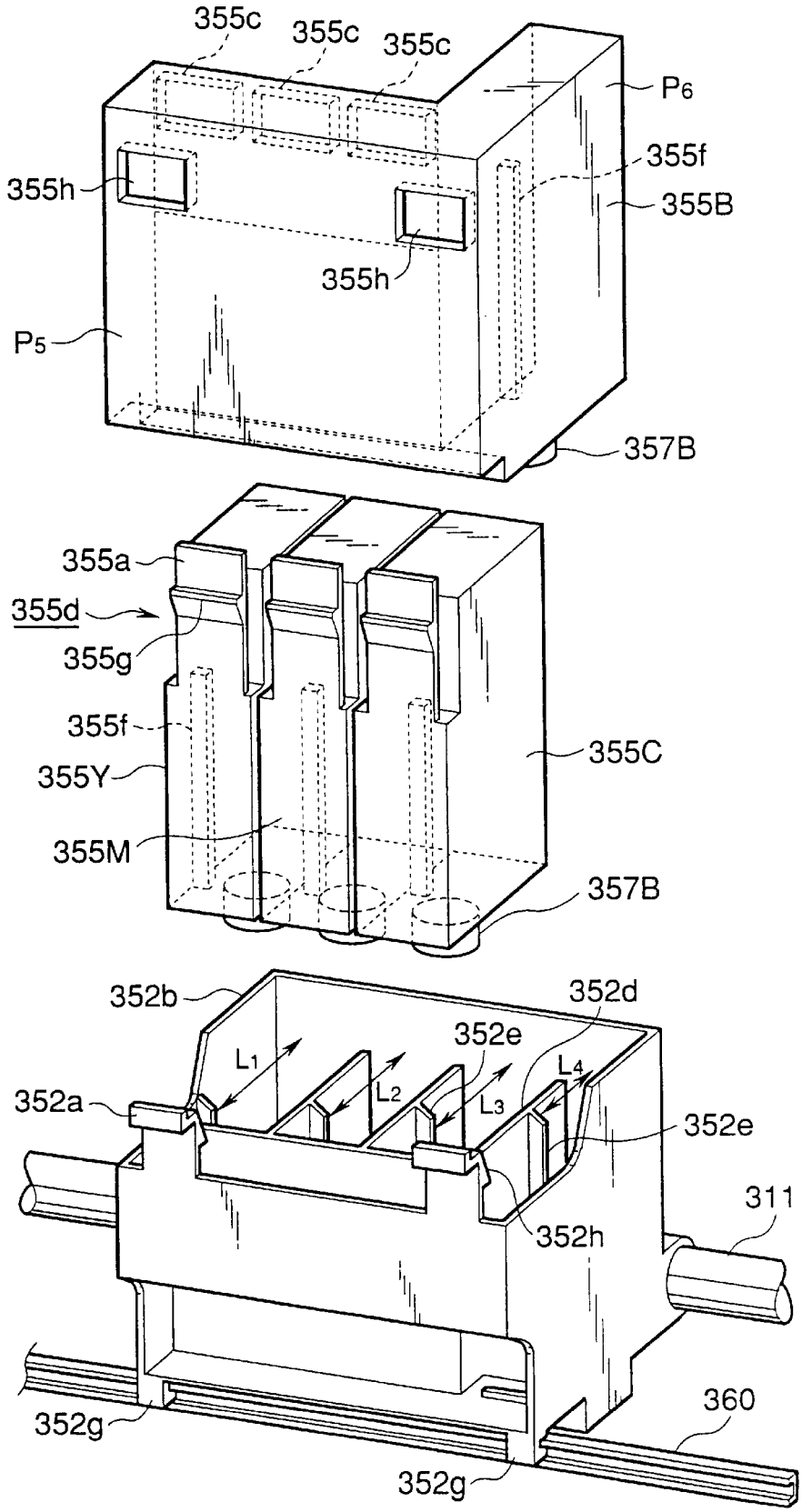
FIG. 5 is an exploded perspective view of a carriage and ink tank unit for an ink jet printer according to a third embodiment.
Figure 6:
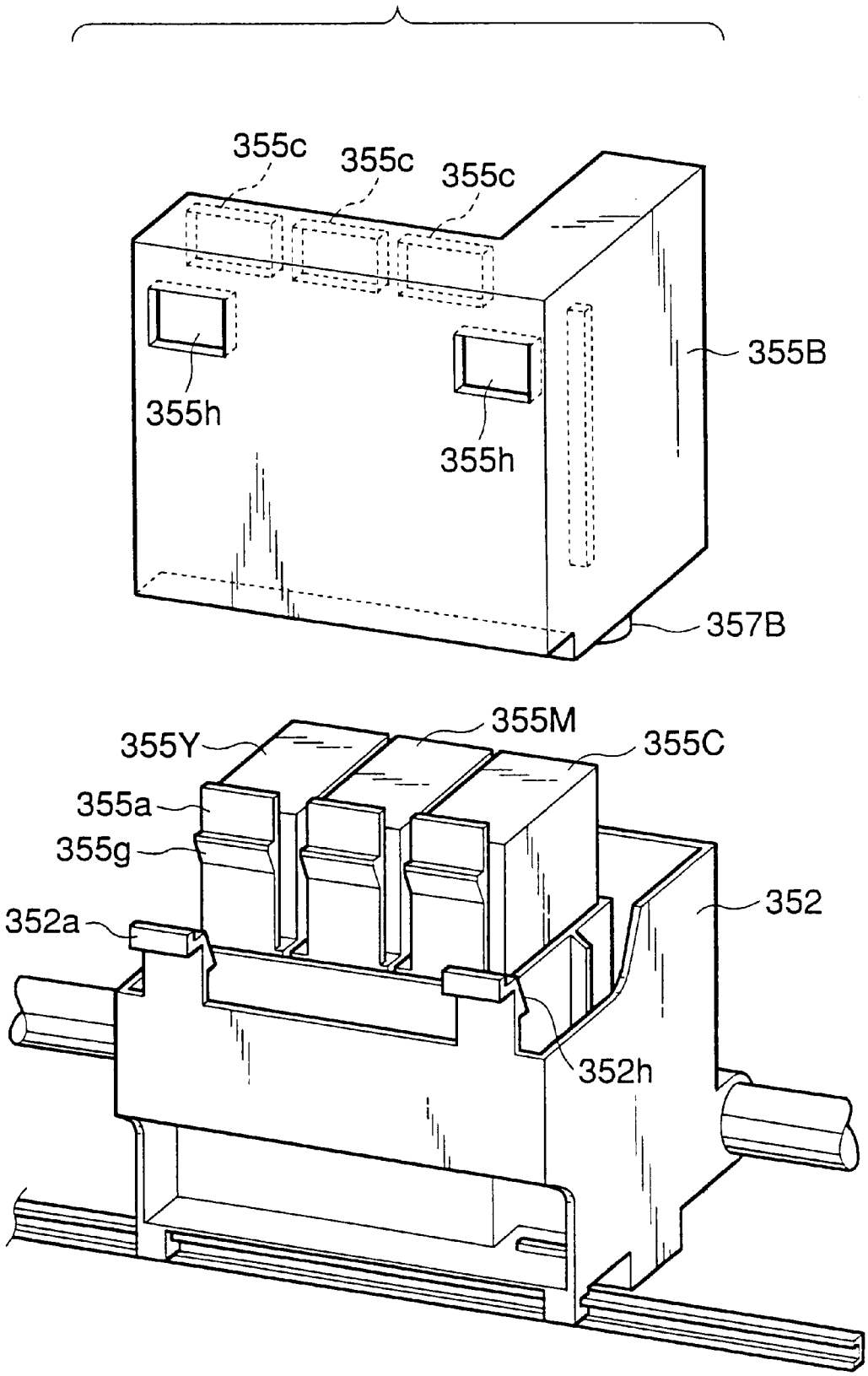
FIG. 6 is an exploded view of ink tanks shortly after they have been attached into the carriage of the third embodiment.

FIGS. 5–6 are exploded perspective view of an ink tank unit and a carriage according to a third embodiment.

The third embodiment differs from the first and second embodiments in that ink tanks can be attached into and taken out from the carriage independently of each other. The carriage 352 is of the same construction as the carriage 252 of the second embodiment and therefore the description thereof is omitted.

The ink tank units 355Y, 355M, 355C, and 355B are aligned in this order from left to right in FIG. 5. Four ink tanks 355Y, 355M, 355C, and 355B will be mainly described with respect to portions which are different from those of the second embodiment.

As is clear from FIG. 5, the ink tank 355B includes a portion P5 and a portion P6 which communicate with each other and form a generally L-shape. The portion P5 has three recesses 355*c* in its one side surface and two recesses 355*h* in its other side surface. The upper portion of the portion P3 extends somewhat in a direction shown in FIG. 8.

The ink tank 355Y, 355M, 355C each have an upwardly projecting resilient tab 355*d* which is formed with a latch 355*g* in its middle.

The carriage 352 is slidably held on the carriage shaft 311. Each of walls 352*d* has a guide rib 352*e* which extends vertically along the wall 352*d*. The guide ribs 352*e* are formed on the walls 352*d* such that they are at mutually different distances L1, L2, L3, and L4 from corresponding ends of the walls 352*d*. The distances L1, L2, L3, and L4 are related by L1>L2>L3>L4. The guide ribs 352*e* engage grooves 355*f* formed in the ink tanks to facilitate insertion of an ink tank into a corresponding ink tank room.

FIG. 6 is an exploded view of ink tanks 355Y, 355M, and 355C shortly after they have been attached into the carriage 352.

When the ink tank 355B is attached after the ink tanks 355Y, 355M, and 355C have been attached, the latches 352*h* of the carriage 352 snap into the recesses 355*h* in the ink tank 355B to firmly hold the ink tank 355B in place. The recesses 355*c* of the ink tank 355B push the three other ink tanks 355Y, 355M, and 355C downward so that the ink tank 355B securely holds the three other ink tanks in the carriage 352 as shown in FIG. 7.

Figure 7:
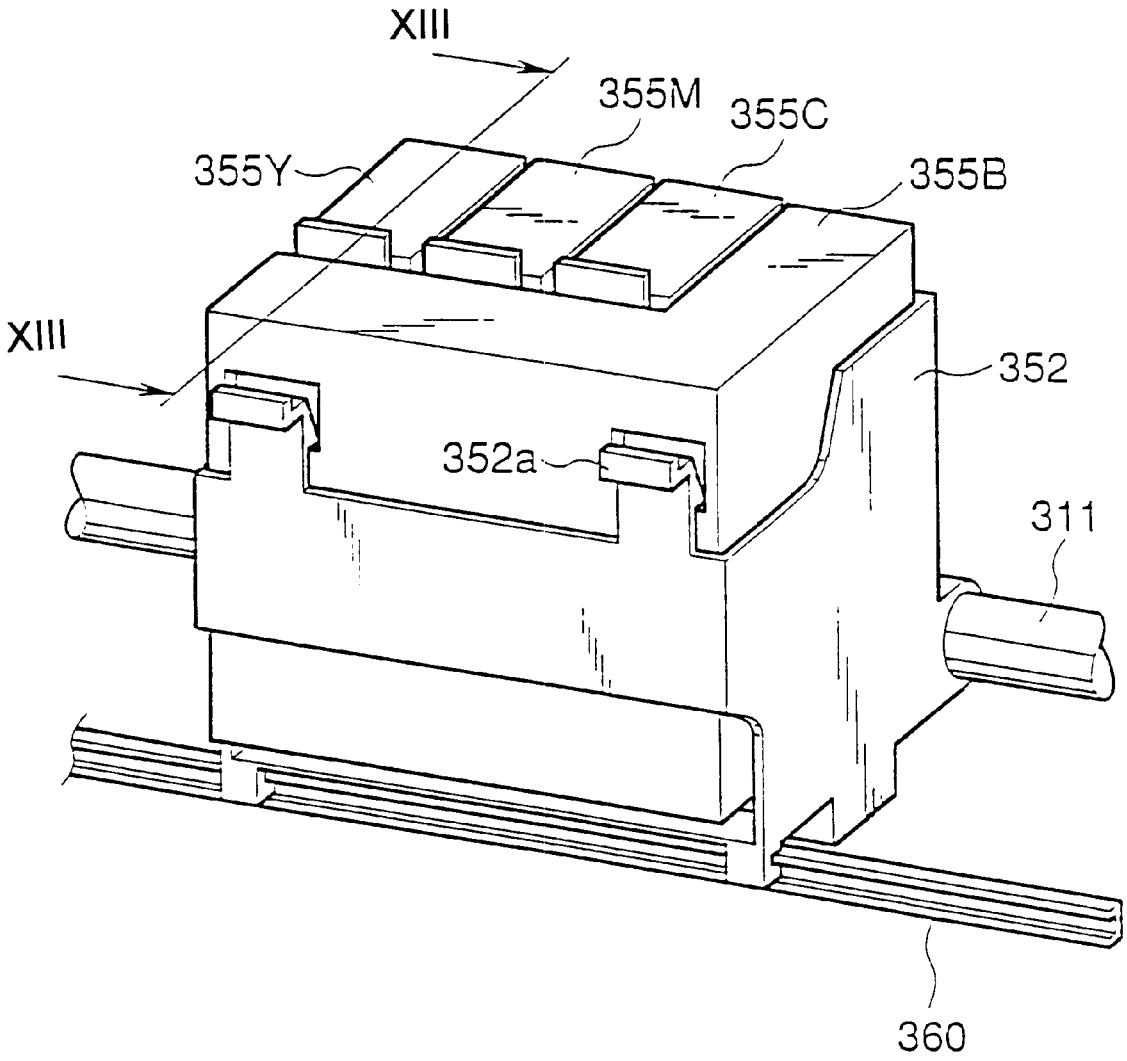
FIG. 7 shows all of the ink tanks of the third embodiment attached in the carriage.
Figure 8:
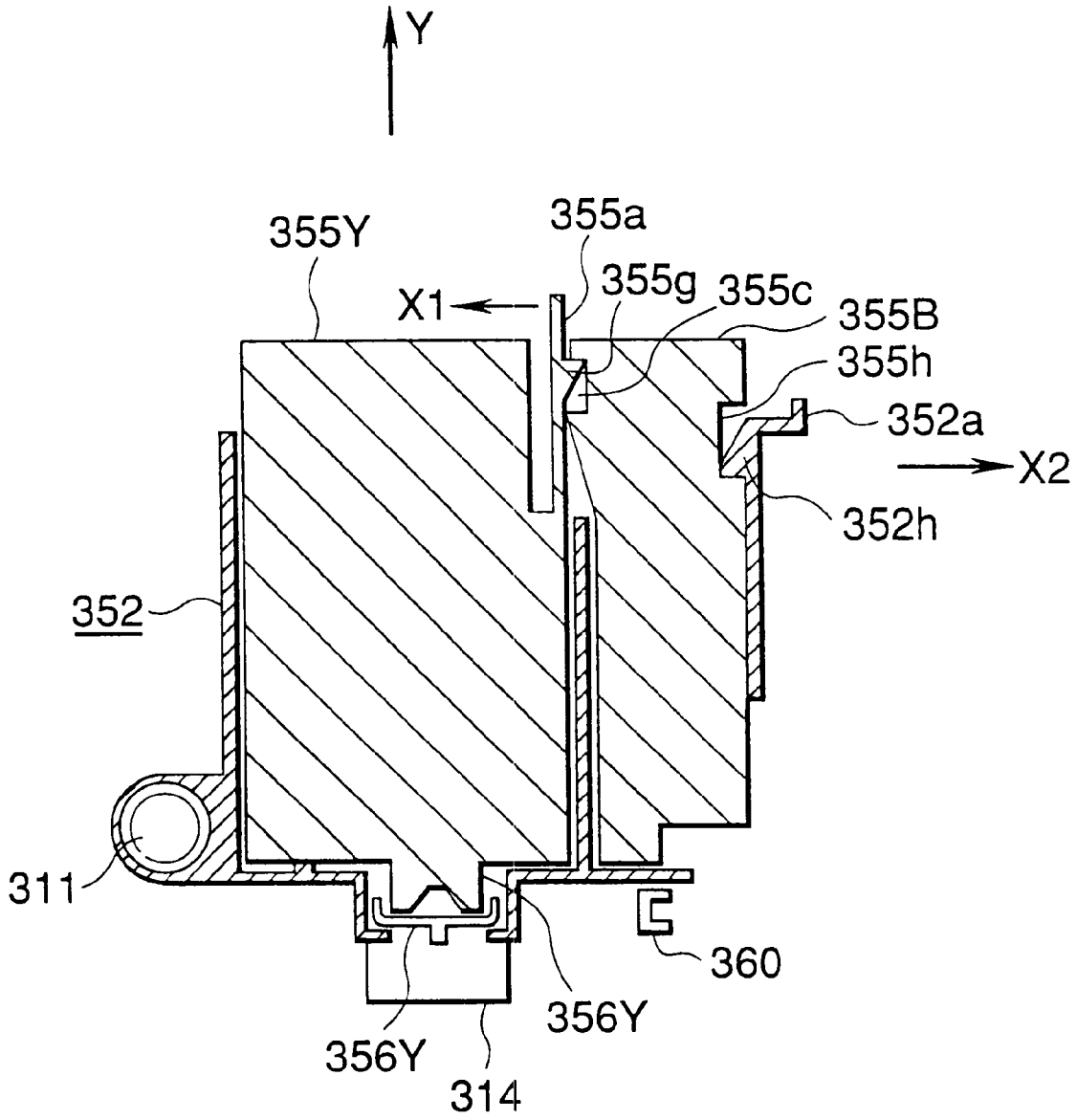
FIG. 8 is a cross-sectional view taken along the lines XIII—XIII of FIG. 7.

FIG. 7 illustrates all of the ink tanks which have been attached in the carriage. FIG. 8 is a cross-sectional view taken along the lines XIII—XIII of FIG. 7. Referring to FIG. 8, the latches 355*g* of the ink tanks 355Y, 355M, and 355C snap into the recesses 355*c* in the ink tank 355B so that the ink tanks 355Y, 355M, and 355C are firmly held in the carriage 352. The ink tanks may be attached in the carriage in an arbitrary sequence.

As is clear from FIG. 8, the ink tank 355B is held firmly by the latches 352*h* and the latches 355*g* of the ink tanks of primary colors 355Y, 355M, and 355C engage the recesses 355*c* to firmly hold the ink tanks of primary colors. For example, when taking out the ink tank 355Y from the carriage 352, the tabs 355*a* are pulled in a direction shown by arrow X1 and the ink tank 355Y is grasped by the hand and subsequently pulled in a direction shown by arrow Y. Similarly, when taking out the ink tank 355B from the carriage 352, the tabs 355*a* are pulled in a direction shown by arrow X2 and the ink tank 355B is grasped by the hand and subsequently pulled in the direction shown by arrow Y.

The invention being thus described, it will be obvious that the same may be varied in many ways. Such variations are not to be regarded as a departure from the spirit and scope of the invention, and all such modifications as would be obvious within the scope of the following claims.

Fourth Embodiment

Figure 9:
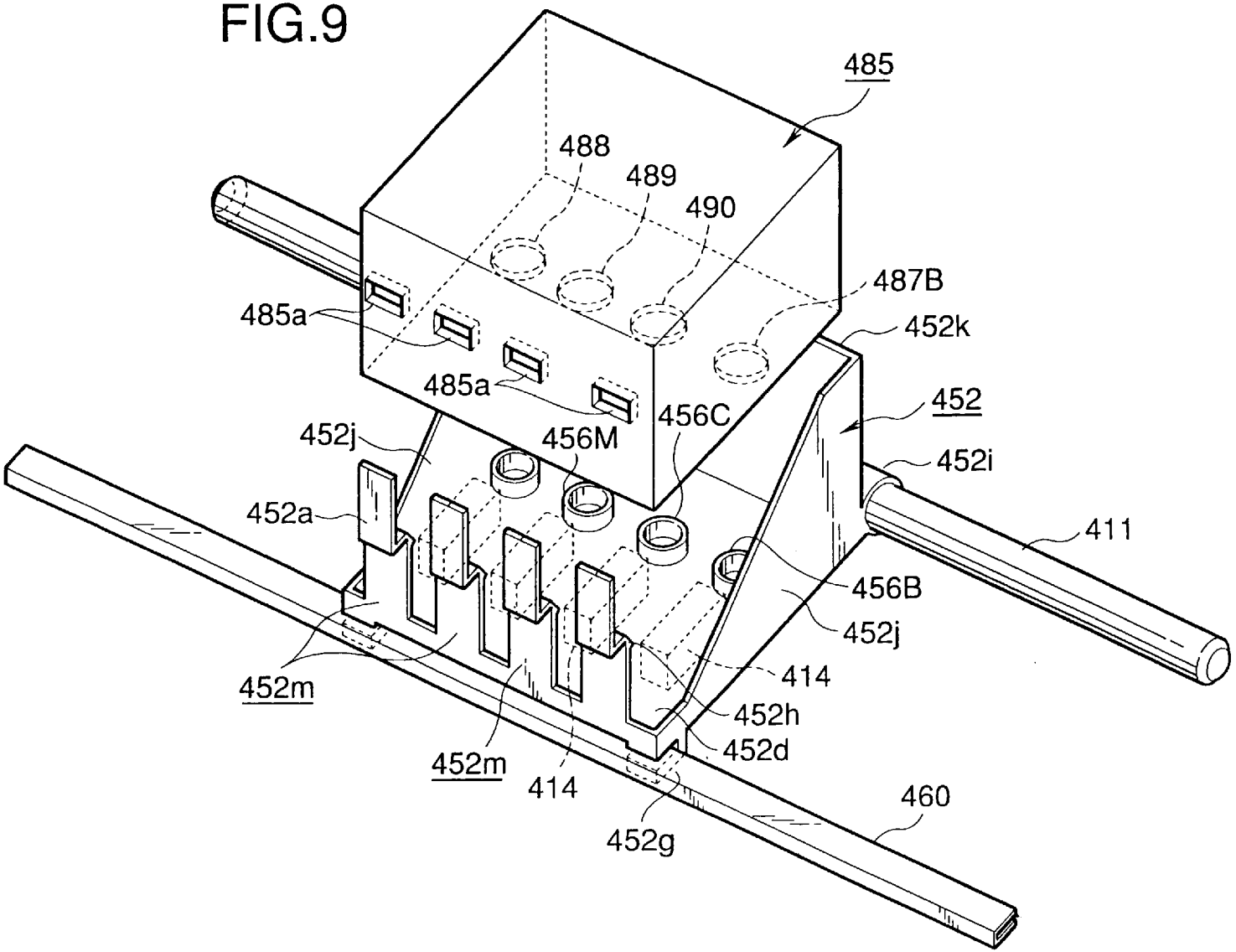
FIG. 9 is an exploded perspective view of a carriage and ink tank unit for an ink jet printer according to a fourth embodiment.

FIG. 9 is an exploded perspective view of a carriage and ink tank unit for an ink jet printer according to a fourth embodiment.

Figure 10:
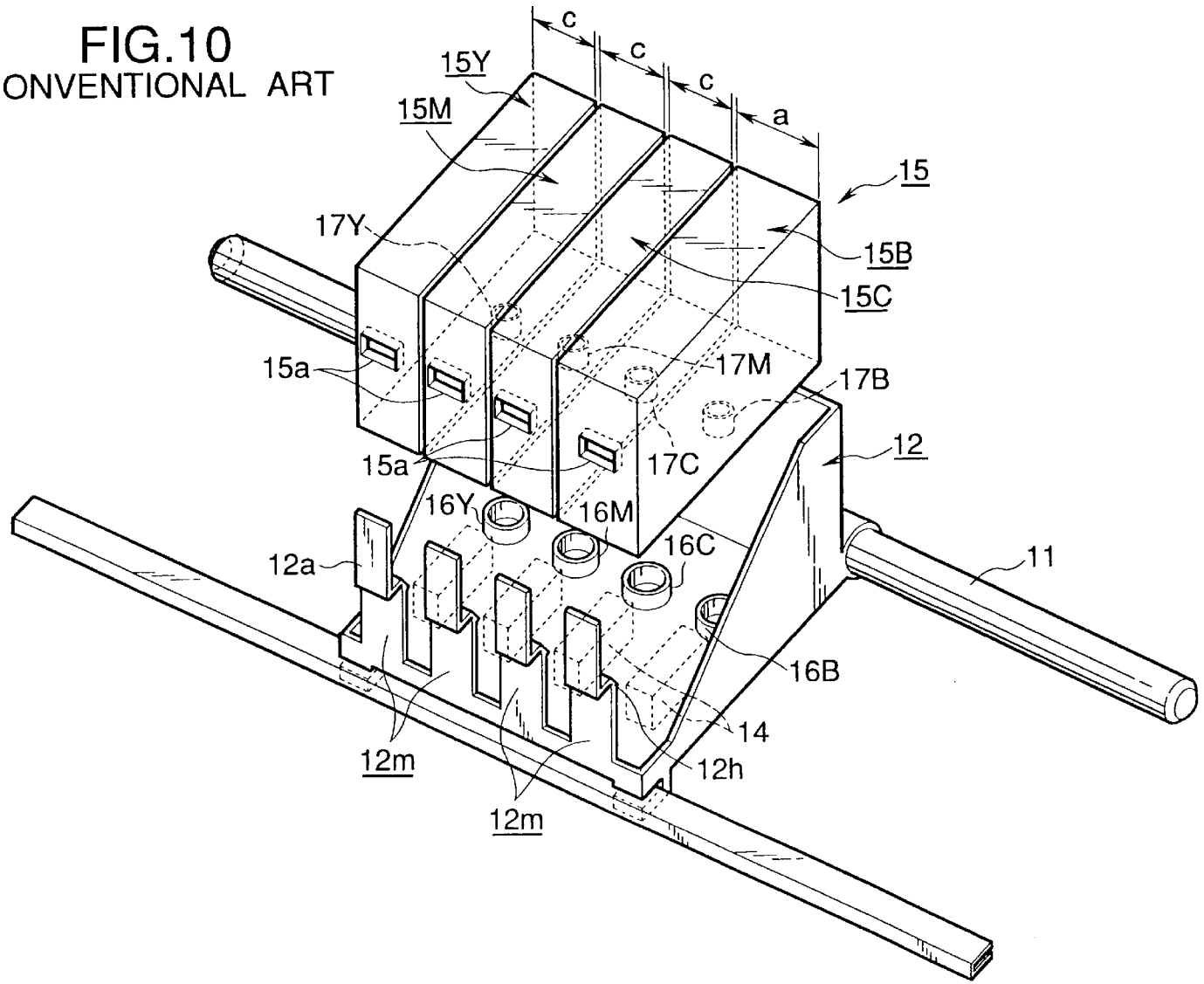
FIG.10 CONVENTIONAL ART
FIG. 10 is a perspective view of a relevant portion of a conventional ink jet printer.

The fourth embodiment is directed to a construction where a single black ink tank 485 of a large volume is provided for monochrome printing. The construction is the same as the conventional construction shown in FIG. 10 except for an additional black ink tank 485 and therefore description will be given only for the construction related to the black ink tank 485.

The carriage 452 carries four printheads 414 and an ink tank unit 455 thereon. The carriage 452 is slidably supported on a carriage shaft 411 and guide rail 460 using guide latches 452*g* and reciprocated along the guide rail 460 and the carriage shaft 411. The carriage shaft 411 slidably extends through a support 452*i* and the guide latches 452*g* slide on the guide rail 460. The carriage includes two opposing triangular side walls 452*j* and a rear wall 452*k* between the two side walls 452*j*, and a bottom wall 452*d*. The bottom wall 452*d* is provided with ink entrances 456Y, 456M, 456C, and 456B and four printheads 414. The nozzles of each printhead 414 receives ink from a corresponding ink tank through a corresponding ink entrance. The carriage has four generally flat projections 452*m* rising from the bottom 452*d* at locations opposing the rear wall 452*k*. When the ink tank is attached into the carriage 452, each of the projection 452*m* is formed with a latch 452*h* which engages a corresponding ink tank to hold the tank in position.

Color printers consume black ink more than any other colored ink. Thus, another black ink tank 485 is provided which holds substantially the same amount of ink as the total amount of ink of the three ink tanks of colored inks.

FIG. 9 illustrates the black ink tank 485 just before it is attached into the carriage 452.

Three caps 488–490 which are made of a resilient material and project downwardly from the bottom of the ink tank 485 at locations corresponding to the ink entrances 456Y, 456M, 456C, and 456B. Thus, when the ink tank 485 is attached in the carriage 452, the caps 488–490 are pressed against the ink entrances 456Y, 456M, and 456C to completely seal the ink entrances 456Y, 456M, and 456C against the environment. The ink exit 487 fits into the ink entrance 456B. There are provided four recesses 485*a* in the side wall of the ink tank 485. When the ink tank 485 is attached into the carriage 485, the latches 452*h* on projections 452*m* snap into the corresponding recesses 485*a* to firmly hold the ink tank 485 in place. When taking out the ink tank 485 from the carriage, the user simply pulls tabs 452*a* of projections 452*m* toward the user so that the latches 452*h* disengage from the recesses 485*a*. The ink tank 485 is exposed beside the triangular walls and therefore the ink tank 485 can be grasped easily with fingers to take out the ink tank from the carriage 452.

Since the ink exits 456Y, 456M, and 456C are firmly capped with the caps 488–490, there is no possibility of foreign materials of entering through the ink entrances while also preventing the ink from drying out. In this manner, the ink tanks of yellow, magenta, and cyan inks, not shown, and the ink tank 485 can be selectively attached in the carriage 452, and therefore the color printing and the monochrome printing can be selectively performed. This feature can save the running cost of the ink jet printer.

The aforementioned construction provides a large volume or capacity of the ink tank 485 as compared to the ink tanks of yellow, magenta, and cyan inks. Thus, volume ratio of the ink tank 485 to the ink tanks of primary colors can be increased without the need for decreasing the width of the ink tanks 475Y, 475M, and 475C.

What is claimed is:

1. An ink jet printer, comprising:

an ink jet print head;

a carriage shaft that extends in a direction;

a carriage movable on said carriage shaft; and a plurality of ink tanks, each being detachably attached in said carriage, said plurality of ink tanks including a first ink tank and a second ink tank, each having an ink supply port connectable to said ink jet print head, said first ink tank having a larger ink capacity than said second ink tank, said second ink tank having a first surface and a second surface that intersects the first surface, said first ink tank including a first portion that extends substantially parallel to the first surface, and a second portion communicating with said first portion and extending substantially parallel to the second surface, wherein when said first ink tank and said second ink tank have been attached in said carriage, the first portion overlaps the first surface and the second portion overlaps the second surface and said second portion is aligned with said second ink tank in the direction.

2. The ink jet printer according to claim 1, wherein said first ink tank and said second ink tank are attached in said carriage such that said first ink tank holds said second ink tank with said first portion extending over a top portion of said second ink tank.

3. The ink jet printer according to claim 1, wherein the first surface is a top surface of said second ink tank and the second surface is a side surface of said second ink tank, and said first portion extends over the top surface of said second ink tank.

4. The ink jet printer according to claim 1, wherein said first ink tank is formed with a first engagement portion and said second ink tank is formed with a second engagement portion, said second engagement portion engaging said first engagement portion when said first ink tank and second ink tank have been attached in said carriage.

5. The ink jet printer according to claim 4, wherein said first engagement portion is a projection and said second engagement portion is a stepped portion formed to be complementary to said projection.

6. The ink jet printer according to claim 4, wherein said first ink tank and said second ink tank are attachable to and detachable from said carriage independently of each other.

7. The ink jet printer according to claim 4, wherein said carriage includes a projection which engages said first ink tank placed in engagement with said second ink tank to firmly hold said first ink tank down in said carriage when said first ink tank has been attached into said carriage, whereby said first ink tank and said second ink tank are firmly held in said carriage.

8. The ink jet printer according to claim 1, wherein said carriage has walls which define rooms for accommodating said first and second ink tanks therein, said walls having projections extending in an insertion direction of said plurality of ink tanks into said carriage, said projections being at mutually different distances from corresponding ends of said walls, and each of said plurality of ink tanks is formed with a vertically extending groove into which said projection slides when each of said plurality of ink tanks is inserted into said carriage.

9. The ink jet printer according to claim 1, wherein said first portion and said second portion are connected together to form a generally L-shape.

10. The ink jet printer according to claim 1, wherein the first surface is a first side surface of said second ink tank and the second surface is a second side surface of said second ink tank, said first portion extends around the first side surface of said second ink tank.

* * * * *